US005296899A

United States Patent [19]

Day

[11] Patent Number: 5,296,899

[45] Date of Patent: Mar. 22, 1994

[54] SEGMENTED BACKING ASSEMBLY FOR TONING AN ELECTROSTATIC IMAGE

[75] Inventor: Gene F. Day, Hillsborough, Calif.

[73] Assignee: Phoenix Precision Graphics, Inc., Sunnyvale, Calif.

[21] Appl. No.: 28,371

[22] Filed: Mar. 9, 1993

Related U.S. Application Data

[63] Continuation-in-part of Ser. No. 930,779, Aug. 17, 1992, Pat. No. 5,231,455.

[51] Int. Cl.[5] ..... G03G 15/10

[52] U.S. Cl. ..... 355/256; 118/659

[58] Field of Search ..... 355/256, 261, 262, 263; 118/647.50, 659, 660

[56] References Cited

U.S. PATENT DOCUMENTS

| | | | |
|---|---|---|---|
| 3,929,099 | 12/1975 | Szymber et al. | 355/256 Y |
| 4,172,430 | 10/1979 | Barone | 118/660 |
| 4,262,294 | 4/1981 | Hara et al. | 346/155 |
| 4,438,444 | 3/1984 | Komada et al. | 346/155 |

FOREIGN PATENT DOCUMENTS

| | | | |
|---|---|---|---|
| 59-230766 | 12/1984 | Japan | 355/262 |

*Primary Examiner*—Joan H. Pendegrass
*Attorney, Agent, or Firm*—Schneck & McHugh

[57] ABSTRACT

An apparatus for retaining a recording medium in close proximity to a toner applicator using a segmented backing support, wherein the backing support is comprised of several closely spaced backing segments. Each of the segments is elastically mounted above the recording medium such that the segments are pushed against the recording medium. The downward force exerted on the recording medium by the backing segments is sufficient to overcome the upward force generated on the recording medium by air and toner expelled from the surface of the toner applicator. As a result, the recording medium is kept close enough to the toner applicator such that air does not leak excessively from between the toner applicator and the recording medium. A plurality of the backing segments are arranged closely together such that the recording medium is pressed against the toner applicator along the entire surface of the toner applicator. The position of each of the backing segments is adjustable to variations in the surface of the toner applicator. Additionally, the backing segments may be used to control the voltage on the recording medium.

21 Claims, 4 Drawing Sheets

SEGMENTED BACKING ASSEMBLY FOR TONING AN ELECTROSTATIC IMAGE

CROSS REFERENCE TO RELATED APPLICATION

This is a continuation-in-part of patent application Ser. No. 07/930,779 filed Aug. 17, 1992, now U.S. Pat. No. 5,231,455.

TECHNICAL FIELD

The present invention pertains to the field of electrostatic printing and copying. Specifically, the present invention pertains to an apparatus for retaining a recording medium against a toner applicator in electrostatic printing and copying.

BACKGROUND ART

In electrostatic printing and copying systems, an electrostatic writing head is commonly used to form a latent image of electrical charges onto a recording medium such as a paper web. The paper web carrying the latent image is then directed to a liquid toning applicator which deposits oppositely charged toner particles onto the paper web, thereby developing the latent image.

Such liquid toning applicators can be classified as pressure-type or suction-type. In suction-type applicators, a liquid pump is used to draw toner from a toner reservoir into the applicator and across one or more channels in the face of the applicator, wherein the toner comes into contact with the paper web. The flexible web serves to seal the face of the applicator thus permitting the pump, connected to the applicator outlet, to create a vacuum or suction in the channels and thereby draw toner into the applicator from a toner reservoir. The outlet of the toner pump returns the spent toner to the toner reservoir. In this manner a continuous recirculation of the toner occurs. The flexible paper web thus forms a liquid seal around the periphery of the applicator assuring that pressure differences are maintained. The face of the applicator must be oriented upward to insure that the toner is not spilled. If the paper web is pulled away from the applicator, damaged, or is simply depleted, the vacuum seal is broken, all liquid pumping ceases, and the toner flows gravitationally back into the toner reservoir. As a result, suction-type toner applicators are virtually leak-proof.

Despite the advantage of leak protection, suction-type applicators are severely limited by slow toning speeds. Since the paper web comes into contact with the toner in a channel of decreased pressure, the edges of the channel must support the web against the inward suction force. For this reason, the channels must be no greater than about a tenth of an inch wide in order to prevent the paper web from being pulled down into the toning channel and cutting off the flow of toner. To compensate for this narrow channel size, several parallel channels are incorporated into the face of the applicator. A practical design has these narrow channels aligned perpendicular to the direction of movement of the web. Such toning applicator systems are referred to as "cross-flow" applicators.

As the speed of the web passing over a cross-flow applicator is increased, more and more channels are required in order to insure that adequate toning occurs. As additional channels are incorporated into the applicator, the paper web is subjected to greater sliding friction. Furthermore, narrower channels, which can typically be up to 36 inches long, require stronger suction from the liquid pump in order to get the toner to quickly flow therethrough. This adds to the downward force on the paper web, and further increases the sliding friction. As web speeds approach 2 inches per second, the speed necessary for high speed plotting or printing, the number of required channels is so great that the sliding friction of the web against the applicator becomes impractical. Thus, suction-type applicators are restricted optimally to web speeds below approximately 1 inch per second.

Pressure-type applicators function in a slightly different manner. Instead of using a vacuum to draw toner across the face of the applicator, the toner is pumped out of a toner reservoir using positive pressure. In one embodiment of a pressure-type applicator the toner is pushed by positive pressure through a channel in the applicator and finally received by an inlet port on the opposite side of the applicator channel for continuous recirculation. Thus, pressure-type applicators do not create suction in the applicator channels, and sliding friction of the paper web is greatly reduced.

Since suction is no longer a problem, pressure-type applicators are freed from the "narrow-channel" geometries of suction-type applicators. For instance, the channel can be almost the full size of the applicator's contacting surface, extending across the entire width of the paper web, and the full extent of the applicator in the direction of movement of the web. One such "full-width" channel can be as effective as ten or twenty cross-flow channels, and almost totally without paper sliding friction. As a result, far higher web speeds can be employed without system compromises or image quality sacrifices.

However, manufacturing such "full width" channel applicators creates additional complications. When a broad surface such as the surface of the applicator is manufactured, geometric irregularities in the surface occur. That is, the applicator surface is not completely flat. Furthermore, pressure-type applicators are hampered by toner leakage. Even when precisely designed and constructed, toner leakage still occurs around the edges of the applicator. Often there is no attempt to minimize leakage, and the flow of toner is simply collected by a bucket or funnel situated underneath the applicator, and then recirculated. Using buckets increases the cost of the system, and the buckets also require occasional cleaning. Additionally, in applicator systems in which a single applicator is used for several different colored toners, the use of buckets results in color cross contamination due to toner mixing within the buckets.

As described in co-pending U.S. Pat. application Ser. No. 07/998,458, positive air pressure may be used to confine the toner fluids to the surface of the applicator in a pressure-type system. In such a system, air is introduced at the peripheral edges of the applicator surface, at a pressure greater than the pressure of the fluids confined within the applicator. The high pressure air prevents fluid leakage from the edges of the toner applicator, thereby eliminating the need for a funnel or bucket to catch spilled toner. In so doing, a difficult cleaning problem is eliminated, and a single applicator may be used for multiple color toning.

Unfortunately, the high pressure air used to confine the toner to the surface of the applicator pushes the paper web away from the toner applicator. To overcome the problem of web-applicator separation, the paper web may be held in place using a backing support which serves the dual purpose of keeping the web grounded during toning, as well as holding the web flat against the surface of the applicator. In pressure-type systems using pumps or blowers to create positive air pressure, the web must be maintained at a distance of no greater than 1-2 thousandths of an inch from contacting surfaces throughout the entire surface area of the applicator, otherwise the cost of supplying enough air to the applicator surface becomes impractical.

However, manufacturing two broad surfaces, such as a backing support and a toner applicator, which are mated to within 1-2 thousandths of an inch of each other is extremely costly. That is, forming a backing support which exactly matches the geometric irregularities in the surface of the applicator is cost prohibitive. Furthermore, lower cost mass-produced backing supports do not have the required accuracy necessary to precisely retain the paper web in close proximity to the applicator surface such that excess leakage of air is prevented.

Therefore it is an object of this invention to provide a backing support which is able to retain a recording medium in close proximity to an applicator, without requiring costly machining, and which will conform to variations in the surface of the applicator such that leakage of air from between the applicator and the recording medium is prevented.

SUMMARY OF THE INVENTION

This object has been achieved with a segmented backing support comprised of a plurality of closely spaced backing supports which flexibly retain the recording medium in close proximity to the surface of the applicator such that excess air does not leak from between the surface of the applicator and the recording medium. This is accomplished by elastically mounting a plurality of closely spaced backing supports above the recording medium and applicator such that a flat lower surface of each of the backing supports is pushed against the recording medium with sufficient force to hold the recording medium within 1-2 thousandths of an inch from the surface of the applicator. Each segment of the segmented backing support is independently mounted such that it may adjust to precisely conform to variations in a particular region of the applicator surface. The segments of the backing support may also be maintained at zero volts to assist in the removal of excess charge from the surface of the recording medium during the toning process.

By using a plurality of backing segments, each segment conforms to the variations of only a small region of the applicator surface. Having many closely spaced segments which adjust to conform to smaller areas of the toner applicator eliminates the need for a much larger and more costly single backing support machined to match the entire surface of the applicator.

Therefore, the present invention provides a backing support which precisely conforms to the surface of a toner applicator. In so doing a paper web may be maintained in uniform and intimate contact with the surface of the applicator allowing for effective toning, and preventing excess leakage of air from between the surface of the applicator and the paper web. Furthermore, the present invention allows such a backing support to be formed using mass-produced parts, thereby eliminating the need for costly machining of the backing support.

BEST MODE FOR CARRYING OUT THE INVENTION

Figure 1:
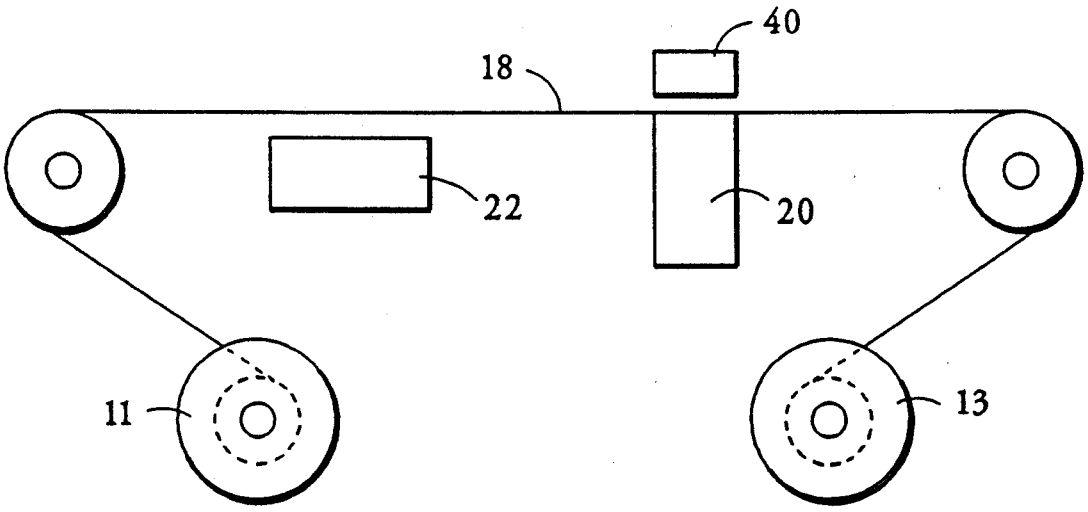
FIG. 1 is a simplified schematic view of an electrostatic printing and copying apparatus utilizing a toner applicator in accord with the present invention.

With reference to FIG. 1, an electrostatic printing and copying system is shown in accord with the present invention. Paper supply roller 11 and take-up roller 13 accurately position paper web is, and maintain tension in web 18. The toner applicator 20 spans the width of paper 18. Liquid toner is supplied to applicator 20 and flows across the entirety of an exposed upper applicator surface, a channel 24, allowing toner particles to adhere to charged regions of paper web 18. An electrostatic writing head 22 is located upstream from toner applicator 20. Head 22 is a scanning head which moves across the width of paper web 18, similar to scanning heads of dot matrix printers. However, instead of applying ink to paper by means of a ribbon, head 22, having an array of closely spaced wires connected to a high voltage supply, merely deposits an electrostatic charge in an analogous manner, thereby writing a latent image on paper web 18. The segmented backing support 40 resides above toner applicator 20, such that paper web 18 is disposed between segmented backing support 40 and toner applicator 20.

Figure 2:
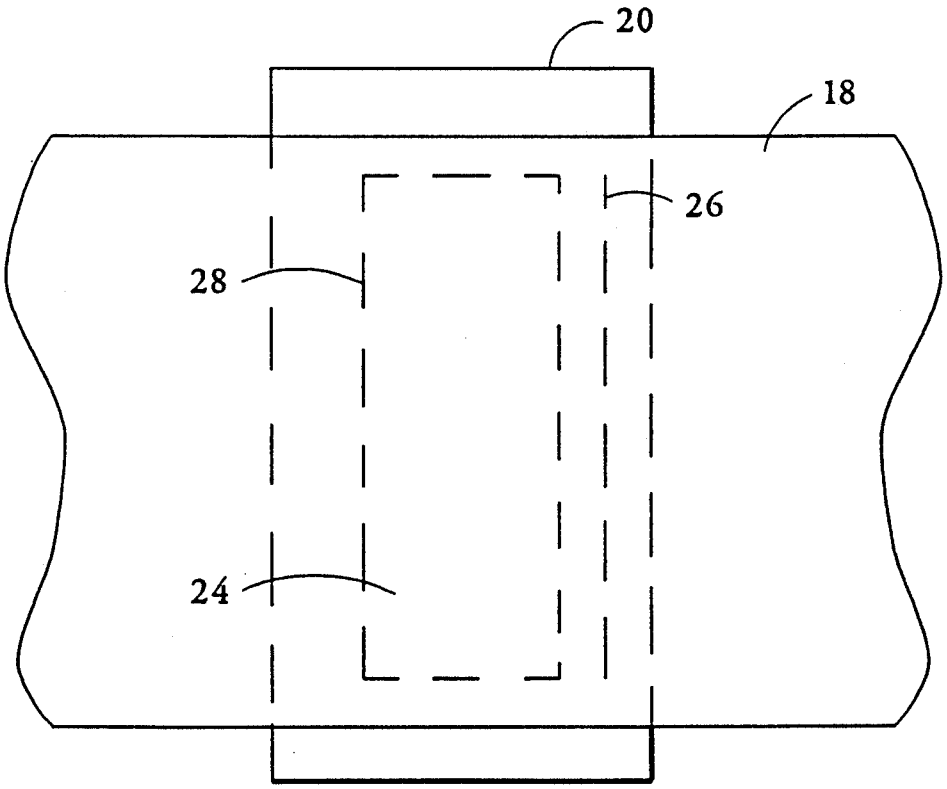
FIG. 2 is a top view of the toning shoe and applicator of FIG. 1 in accord with the present invention.

Referring now to FIG. 2, a partial top view of FIG. 1 is shown with the segmented backing support removed such that the alignment of paper web 18 over toner applicator 20 is more clearly illustrated. As can be seen in FIG. 2, toner applicator 20 spans the entire width of paper web 18. Paper web 18 is typically 36 inches in width. Applicator 20, having a working surface defined by area 24, applies liquid toner across the entire width of web 18 except for small border regions at each edge. Working surface 24 may be as much as 36 inches in length, and have a width of 1-2 inches. Paper web 18 is controlled so that it moves across toner applicator 20 such that the entire image surface of web 18 has toner applied thereto via applicator 20. Air knife 26 removes excess toner from web 18 at the downstream edge of applicator 20. Surface 24 of applicator 20 is surrounded by a slit 28, through which high speed air is passed such that the liquid toner is confined to working surface 24. The segmented backing support, not shown, resides directly above applicator 20, and is used to retain paper web 18 in close proximity to surface 24 such that air expelled from slit 28 does not leak out excessively from between surface 24 and paper web 18.

Figure 3A:
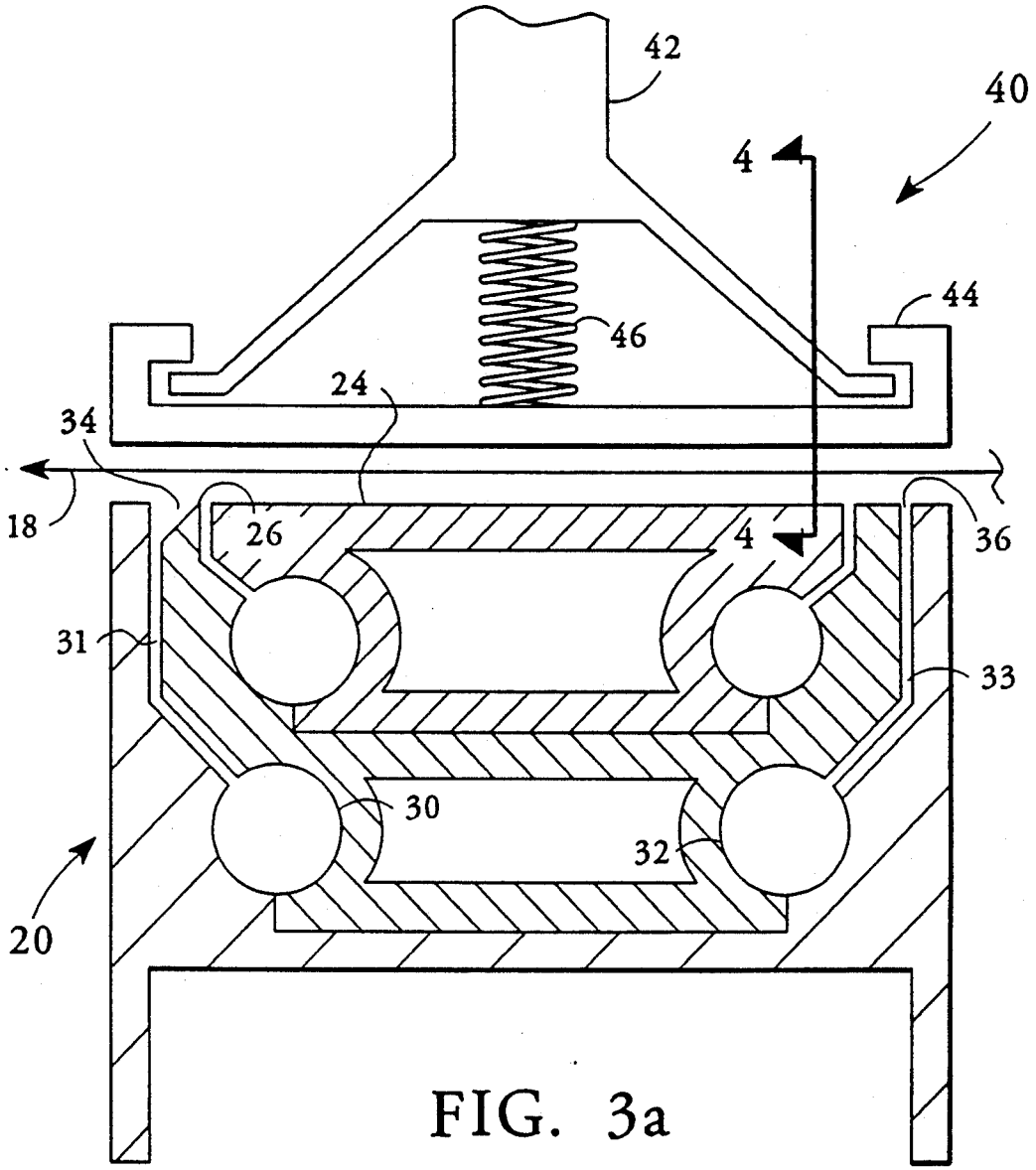
FIG. 3*a* is a side sectional view of a toner applicator and segmented backing support in accord with the present invention.

With reference now to FIG. 3*a*, a side sectional view of a toner applicator 20 and the segmented backing support 40 of the present invention is shown. Although applicator 20 is shown "free-standing" in FIG. 3, in practice, applicator 20 will be supported by a structure contained within the housing of a printer or copier. Air from an air supply means, not shown, is supplied to airways 30 and 32. Air flows upward through airway slits 31 and 33 until it reaches upper surface 24 of applicator 20. The air pressure at the topmost ends 34 and 36 of airway slits 31 and 33 is greater than the liquid pressures, preferably less than 0.1 pounds per square inch, in the surface 24 lying between topmost ends 34 and 36, so as to fully contain the toner and prevent leakage of the toner beyond the long edges of applicator 20. In practice the air pressure is maintained at about 0.2 to 0.3 pounds per square inch (psi) by a blower such as the RDC Revaflow Radial Blower, Model RDC12HH, manufactured by EG&G Rotron, Saugerties, New York. At the near and far ends of applicator 20, U-shaped passages or grooves, open at the top, are provided in the upper surface of the ends of applicator 20 in such a manner as to connect topmost ends 34 and 36 with each other at both the near and the far ends of applicator 20. These two passages together with topmost ends 34 and 36 form a rectangular slit 28 shown in FIG. 2.

Referring again to FIG. 3*a*, segmented backing support 40 is shown slightly separated from paper web 18 for clarity. Segmented backing support 40 has a cross member 42 which runs along the entire length of applicator 20. Backing segments 44 are then independently attached using a compressed spring 46 to cross member 42. Backing segments 44 are formed having a flat bottom surface which bears against paper web 18, thereby holding web 18 in close proximity to applicator 20 so as to prevent excess air loss from between web 18 and applicator 20.

Figure 3B:
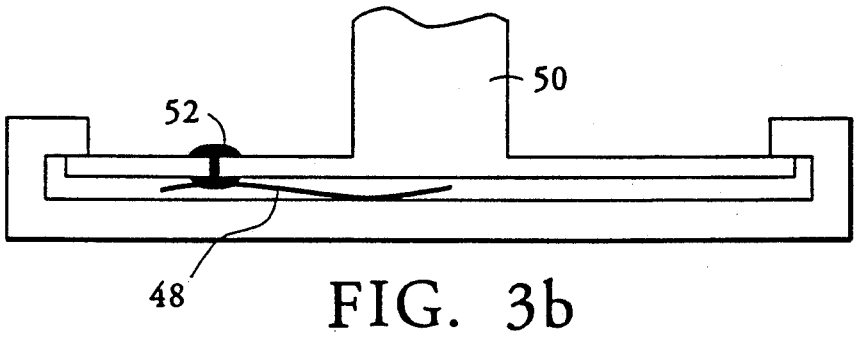
FIG. 3*b* is a side sectional view of an alternate embodiment of an elastic connecting means in accord with the present invention.

Referring now to FIG. 3*b*, an alternate embodiment of the elastic connecting means used in the present invention is shown. A leaf spring 48 is fixed to cross member 50 by a rivet 52. Although a compressed spring 46 and a leaf spring 48 are shown in FIGS. 3*a* and 3*b*, any other elastic connecting means could be used to attach the backing segments or cross member.

Figure 4:
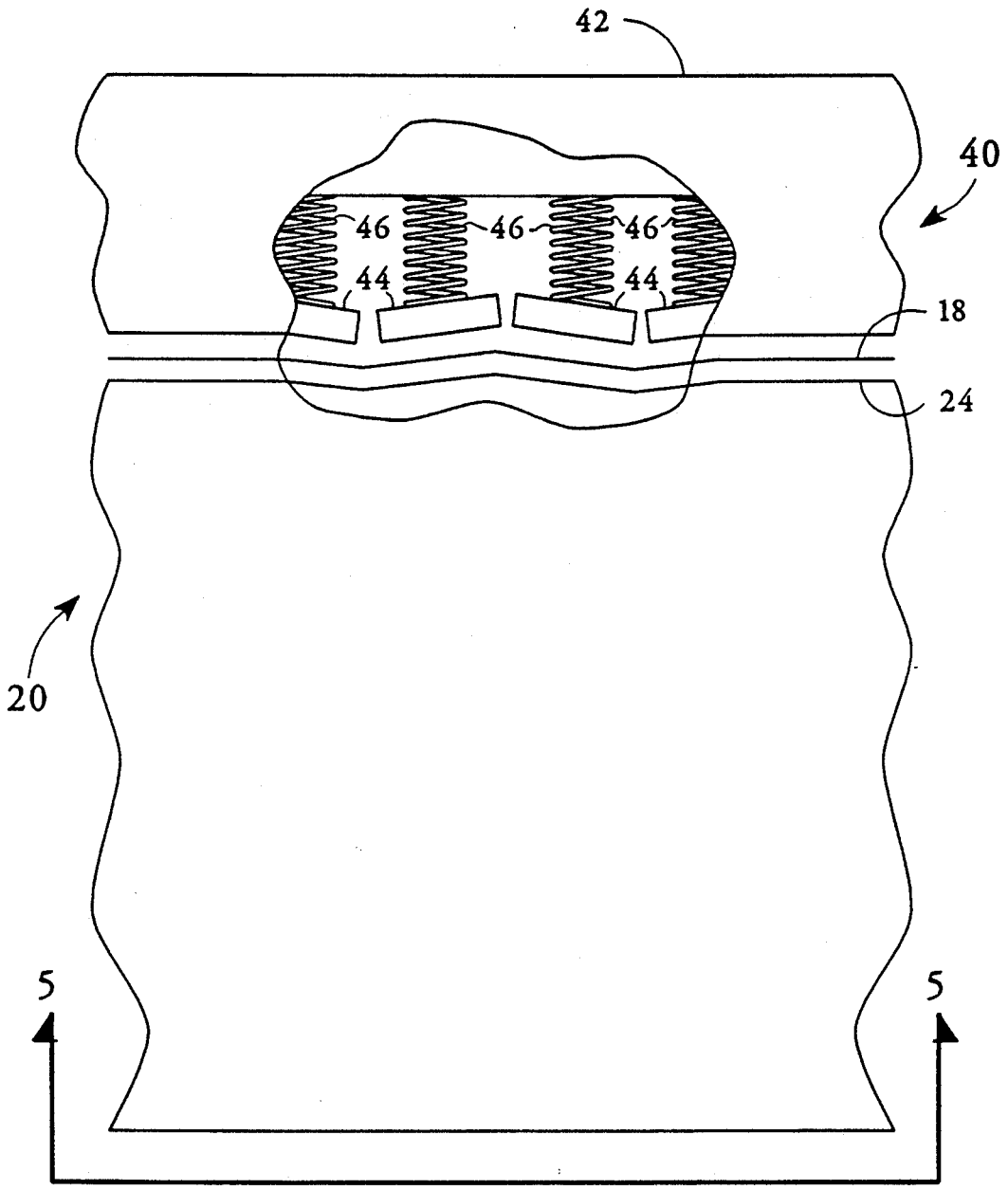
FIG. 4 is a view of the toner applicator and segmented backing support taken along line A of FIG. 3 in accord with the present invention.

With reference now to FIG. 4, backing segments 44 have a length closely matched to the width of applicator 20, and a width of approximately one inch. Thus, by using approximately 36 backing segments 44, paper web 18 may be held in close proximity to applicator 20 along the entire length of applicator 20. Backing segments 44 are attached closely together along cross member 42 such that no large gaps or wide spaces are present between segments 44. Although backing segments 44 may be slightly separated from each other, the separation between segments is not large enough to allow paper web 18 to be lifted from the surface of applicator 20. In so doing, paper web 18 may be held at the desired position along the entire surface of applicator 20 such that no excess air leaks from between applicator 20 and web 18.

Figure 5:
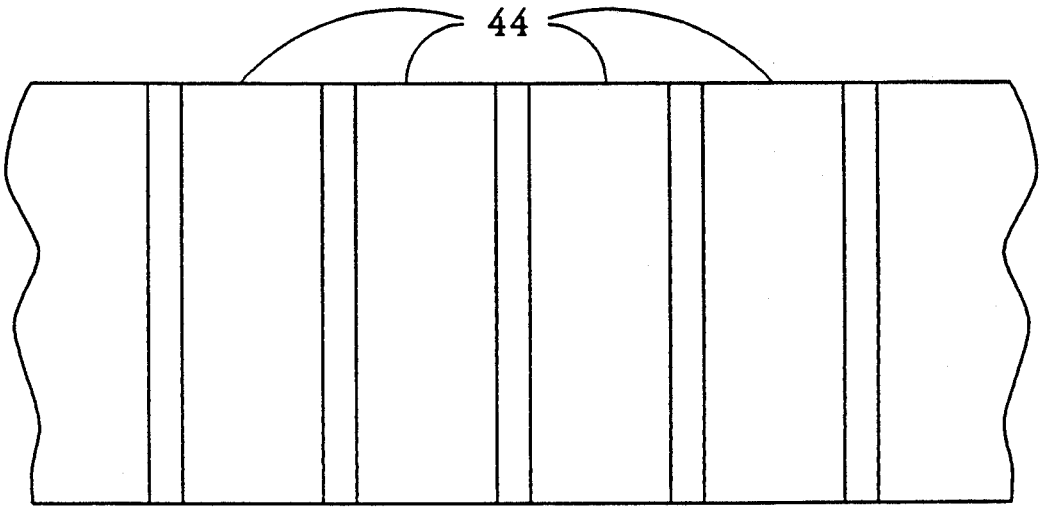
FIG. 5 is a view of the segmented backing support taken along line B of FIG. 4 in accord with the present invention.

By using several backing segments 44 having small contacting surfaces instead of a single larger backing support, the segmented backing support 40 of the present invention may be formed using readily available mass-produced parts. Thus, the considerable expense of machining a single piece backing support precisely conforming to variations in the surface of the applicator is eliminated. Although backing segments 44 have a width of one inch in the preferred embodiment, the methods of the present invention are also suitable for backing segments having different dimensions. A bottom view of the segmented backing support of the present invention having several closely spaced backing segments 44 is shown in FIG. 5.

Referring again to FIG. 4, by attaching backing segments 44 to cross member 42 using springs 46, segments 44 are pushed downward against paper web 18. The downward force exerted on segments 44 by springs 46 counteracts the upward force on web 18 created by the high pressure air expelled from the slits of applicator 20. Specifically, springs 46 exert sufficient downward force onto each of backing segments 44 such that the web is forced into contact with the applicator 20, thus insuring that any small gap between web 18 and mating surfaces of the applicator 20 is less than 1-2 thousandths of an inch. At such a small distance, excess leakage of air from between applicator 20 and web 18 is eliminated.

Furthermore, springs 46 are centrally attached to backing segments 44 such that segments 44 exert a nearly uniform load on paper web 18. That is, the downward force exerted by segments 44 is consistent throughout the bottom contacting surfaces of segments 44. By means of the central location of the spring contact against the top of each segment 44, the segment is rendered self-leveling or self-seating against applicator 20.

In order for backing segments 44 to consistently retain paper web 18 in uniform and intimate contact with the entire mating surface of applicator 20, backing segments 44 adjust to variations in the surface of applicator 20. Each backing segment 44 is self adjusting in both the horizontal and vertical direction. In the preferred embodiment of the present invention, this is accomplished by attaching springs 46 to the center of segments 44. In so doing, each segment 44 may pivot such that the bottom surface of each segment 44 is parallel to the portion of the surface of applicator 20 directly under each segment 44. As can be seen in FIG. 4, each segment 44 may have a slightly different position to accommodate for variations in the surface of applicator 20. In so doing, backing segments 44 retain paper web 18 in intimate contact with the entire surface of applicator 20. Thus, as paper web 18 is moved across the surface of applicator 20, backing segments 44 assure that web 18 will constantly be maintained in intimate contact with the surface of applicator 20.

In addition to holding paper web 18 in place, backing segments 44 may also serve as grounding electrodes. As an electrostatic writing head deposits an electrostatic image onto one side of web 18, it is necessary to continuously remove electrical charge from the opposite side of web 18 in order to prevent a strong negative potential from appearing in the portion of the web undergoing toning. Such a strong negative potential can cause severe fogging or staining of the image. The segmented back electrode described herein serves as an especially effective grounding electrode and is thus very effective in preventing unwanted fogging and staining of the toned image.

In addition to the above electrical benefit, it is desireable to maintain the web 18 at near electrical ground potential for other reasons. Even if no latent image formation is taking place (no writing), the act of toning itself produces electrical currents which can cause the web to acquire a positive electrical potential. Such a positive electrical potential does not normally cause fogging or staining as does a negative potential, but it can strongly inhibit the toning process from completely taking place. The same effective electrical grounding enabled by the segmented back electrode also enhances the toning process itself and renders it more effective. This not only produces enhanced colors but reduces "residual potential" problems which typically cause color impurities in the finished print.

Therefore, the present invention allows low cost mass-produced parts to be employed in assembling a high precision backing support for retaining a recording medium in close proximity to the surface of a high speed toner applicator, thus preventing excess air loss as well as enabling multiple image quality benefits.

I claim:

1. A backing assembly for an electrostatic recorder or copier comprising:

a positive pressure toner applicator having a length spanning the entire width of a recording medium and having a toning surface thereon, said toning surface in fluid communication with said recording medium for applying toner thereto, said recording medium disposed across said toning surface, said applicator generating pressure against said recording medium, thereby pushing said recording medium away from said applicator, a rigid cross member positioned above and parallel to said toning surface of said toner applicator, said cross member extending in a lengthwise direction completely across said applicator, and a plurality of closely spaced backing segments having flat bottom surfaces, each of said backing segments elastically coupled to said rigid cross member and disposed between said cross member and said applicator, said backing segments urged toward said applicator in a manner balancing said pressure against said recording medium to the extent that said recording medium is spaced in close proximity to said toning surface.

2. The backing assembly of claim 1 wherein each of said backing segments is elastically coupled to said rigid cross member by a spring centrally attached to said top surface of said segments.

3. The backing assembly of claim 1 wherein said backing segments are spaced at a distance of approximately a few thousandths of an inch from said toning surface of said applicator thereby positioning said recording medium in close proximity to said toning surface.

4. The backing assembly of claim 2 wherein said backing segments pivot about said spring centrally attached thereto.

5. The backing assembly of claim 1 wherein said backing segments extend completely across said toner applicator in a widthwise direction.

6. The backing assembly of claim 1 wherein each of said plurality of backing segments extend partially across said toner applicator in a lengthwise direction, said plurality of backing segments collectively extending completely across said applicator in said lengthwise direction.

7. The backing assembly of claim 1 wherein said backing segments are electrically grounded.

8. The backing support for an electrostatic recorder or copier comprising:

a rigid cross member positioned above and parallel to a toning surface of a positive pressure toner applicator, said cross member spanning said applicator in a lengthwise direction, a recording medium movable in a widthwise direction across said toning applicator, said recording medium in fluid communication with said toning surface, said applicator generating pressure against said recording medium, a plurality of closely spaced planar backing segments, each of said planar segments elastically coupled to said rigid cross member by a spring centrally contacting said top surface of said segments, such that said planar segments are disposed between said cross member and said applicator, said springs generating sufficient force to balance said pressure generated by said positive pressure applicator to the extent that said planar segments flexibly space said recording medium in close proximity to said toning surface.

9. The backing support of claim 8 wherein said planar backing segments are pressed against said recording medium with sufficient force that said recording medium is balanced at a distance of approximately a few thousandths of an inch from said toning surface of said applicator thereby positioning said recording medium in close proximity to said toning surface.

10. The backing support of claim 8 wherein said planar backing segments pivot about said spring centrally attached thereto.

11. The backing support of claim 8 wherein planar backing segments extend completely across said toner applicator in a widthwise direction.

12. The backing support of claim 8 wherein each of said plurality of planar backing segments extend partially across said toner applicator in a lengthwise direction, said plurality of backing segments collectively extending completely across said applicator in said lengthwise direction.

13. The backing support of claim 8 wherein said planar backing segments are electrically grounded.

14. An electrostatic recorder or copier system comprising:

a web of material capable of supporting an electrostatic image, said web of material movable from an upstream roll to a downstream roll, means disposed in close proximity to said web of material for forming an electrostatic image onto said web of material, a positive pressure toner applicator having a length spanning the entire width of said web of material and having a toning surface thereon, said toning surface in fluid communication with said web of material for applying toner thereto, said web of material disposed across said toning surface, said applicator generating a force against said web of material, a rigid cross member positioned above and parallel to said toning surface of said toner applicator, said cross member extending in a lengthwise direction completely across said applicator, and a plurality of closely spaced backing segments, each of said backing segments elastically coupled to said rigid cross member such that said backing segments are disposed between said cross member and said applicator, said backing segments urged toward said applicator in a manner balancing said force against said web of material to the extent that said web of material is spaced in close proximity to said toning surface.

15. The electrostatic recorder or copier of claim 14 wherein each of said backing segments is elastically coupled to said rigid cross member by a spring centrally attached said segments.

16. The electrostatic recorder or copier of claim 15 wherein each said backing segment has a substantially planar surface proximate to said web of material.

17. The electrostatic recorder or copier of claim 14 wherein said backing segments urge said web of material toward said applicator in a manner balancing said web or material at a distance of approximately a few thousandths of an inch from said toning surface of said applicator thereby positioning said web of material in close proximity to said toning surface.

18. The electrostatic recorder or copier of claim 17 wherein said backing segments pivot about said spring centrally attached thereto.

19. The electrostatic recorder or copier of claim 14 wherein said backing segments extend completely across said toner applicator in a widthwise direction.

20. The electrostatic recorder or copier of claim 14 wherein each of said plurality of backing segments extend partially across said toner applicator in a lengthwise direction, said plurality of backing segments collectively extending completely across said applicator in said lengthwise direction.

21. The electrostatic recorder or copier of claim 14 wherein said backing segments are electrically grounded.

* * * * *

UNITED STATES PATENT AND TRADEMARK OFFICE

CERTIFICATE OF CORRECTION

PATENT NO. : 5,296,899

DATED : March 22, 1994

INVENTOR(S) : Gene F. Day

It is certified that error appears in the above-indentified patent and that said Letters Patent is hereby corrected as shown below:

Claim 8, column 7, line 65, "The backing support" should read - - A backing support - -.

Claim 18, column 10, line 1, "of claim 17" should read - - of claim 15 - -.

Signed and Sealed this

Ninth Day of August, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,296,899

DATED : March 22, 1994

INVENTOR(S) : Gene F. Day

It is certified that error appears in the above-indentified patent and that said Letters Patent is hereby corrected as shown below:

Column 9, line 5, "of claim 15" should read -- of claim 14 --.

Signed and Sealed this

Twenty-seventh Day of September, 1994

*Attest:*

Bruce Lehman

BRUCE LEHMAN

*Attesting Officer*

*Commissioner of Patents and Trademarks*